United States Patent [19]

Gerrish

[11] 4,054,850

[45] Oct. 18, 1977

[54] NON-CONTACTING RADIO FREQUENCY POWER COUPLER FOR RELATIVE LINEAR MOTION

[75] Inventor: Keith Gale Gerrish, Leroy, N.Y.

[73] Assignee: Eastman Kodak Company, Rochester, N.Y.

[21] Appl. No.: 760,888

[22] Filed: Jan. 21, 1977

Related U.S. Application Data

[63] Continuation of Ser. No. 678,272, April 19, 1976, abandoned.

[51] Int. Cl.[2] ..... H01P 5/00

[52] U.S. Cl. ..... 333/24 R; 219/10.55 A; 333/97 R; 333/99 R

[58] Field of Search ..... 333/23, 24 R, 24 C, 333/27, 97 R, 99 R; 219/10.55 A, 10.81

[56] References Cited

U.S. PATENT DOCUMENTS

| | | | |
|---|---|---|---|
| 2,268,639 | 1/1942 | Braden | 333/27 |
| 2,395,441 | 2/1946 | Alford | 333/97 R |

*Primary Examiner*—Paul L. Gensler

*Attorney, Agent, or Firm*—J. A. Matthews

[57] ABSTRACT

A non-contacting electrical coupler for connecting a linearly movable radio frequency load to a stationary radio frequency power source both having a mean operating wavelength of λ. The coupler comprises a pair of stationary parallel first generally tubular conductor members, each of which have an axially extending opening through the wall thereof. Terminal means are provided near a first end of the first conductor members connecting each of them to opposite sides of the power source. The first conductor members are connected together at a point located a distance substantially equal to odd multiples of λ/4 from the first end. A pair of movable second conductor members are disposed substantially coaxially one within each of the first conductor members. Each of the second conductor members have a length substantially equal to λ/4 and are axially movable within the first conductor members. The second conductor members are provided with terminal means at one end which connect them to opposite sides of the linearly movable load through the axially extending openings through the first conductor members.

10 Claims, 4 Drawing Figures

NON-CONTACTING RADIO FREQUENCY POWER COUPLER FOR RELATIVE LINEAR MOTION

This is a continuation, of application Ser. No. 678,272, filed Apr. 19, 1976, now abandoned.

BACKGROUND OF THE INVENTION

Radio frequency devices are often used in industrial operations, a common example being the application of dielectric heating to the fabrication of articles employing a hot melt adhesive. Utilization of radio frequency or dielectric energy permits the heating of surfaces remote from the outer surface of the article. However, the use of such radio frequency devices may complicate the design of the apparatus due to the care necessary in designing the power supply leads to the high-frequency load, e.g. the dielectric sealer head. While transmission lines that are somewhat flexible are available to the machine designers, the flexibility thereof is somewhat limited, resulting in either restricted movement of the high-frequency load with respect to the power supply, or requiring significant amounts of maintenance because of the fatigue of the transmission lines.

While examples of non-contacting rotary coupling members for the transmission of radio frequency power have been known, as exemplified by U.S. Pat. Nos. 2,439,235 and 2,944,230, no such non-contacting coupling members are known which permit relative linear motion between the radio frequency load and the power supply. Such a coupler would be of advantage to a machine designer for utilization on such devices as reciprocating dielectric heater elements which can be arranged to follow the article, for example, a linearly moving web, for a period of time necessary to provide a seal thereon and then to reverse its motion to pick up the web at a new location.

SUMMARY OF THE INVENTION

Accordingly, the present invention provides a non-contacting electrical coupler for connecting a linearly movable radio frequency load or device to a stationary radio frequency power source or device both having a mean operating wavelength of $\lambda$.

In accordance with one aspect of the present invention, the coupler comprises a pair of parallel first generally tubular conductor members, each of which have an axially-extending opening through the wall thereof. First terminal means is provided at a first end of each of the first conductor members for connecting each of them to opposite sides of either the power source of the load. Means is provided for electrically connecting the first conductor members together at a distance substantially equal to $\lambda/4$ from the first end thereof. A pair of second conductor means are disposed one within each of the first conductor members wherein each of the second members have a length substantially equal to $\lambda/4$ and are arranged for relative axial movement within the first conductor members. Terminal means are provided at one end of each of the second conductor members to connect them to opposite sides of the other of the power source or load, which terminal members extend through the axially extending openings through the first conductor members.

According to another aspect of the present invention, the first conductors are disposed parallel to the direction of the motion of the load.

In accordance with another aspect of the present invention, the terminal means connected to the second conductor members support the second conductor members coaxially within the first conductor members and are rigidly connected to the movable device.

In accordance with still another aspect of the present invention, the first conductor members have a length substantially equal to $\lambda/4$ plus the distance of motion of the second conductor members therein.

In accordance with yet another aspect of the present invention, the means connecting the first conductor members together is arranged to move with the movable second conductor members and the movable device, thereby substantially increasing the amount of relative motion possible between the power supply and the load.

The various features, of novelty which characterize the present invention are pointed out with particularly in the claims annexed hereto and forming part of this specification. For a better understanding of the invention, its operating advantages and the specific objects obtained by its use, reference should be had to the accompanying drawings and descriptive matter in which a preferred embodiment of the present invention is illustrated and described.

DETAILED DESCRIPTION OF THE PREFERRED EMBODIMENT

The present invention provides an electrical coupler for connecting a pair of radio frequency power devices for relative linear motion therebetween without requiring wires, brushes, or any other direct electrical contact and yet still provide high transfer efficiences. Such relatively movable devices may be a stationary power source and a moving load, or a stationary load, which is connected to a stationary power source, and a moving load. The present non-contacting coupler is based on the fact that in quarter wavelength transmission lines the input impedance ($Z_S$) is dependent upon the characteristic impedance ($Z_o$) of the transmission line and the load impedance ($Z_r$). This relationship is expressed by the following formula: $Z_s = (Z_o)^2/Z_r$. From this formula it will be seen that, if $Z_o$ is a finite value and $Z_r$ is very large in comparison to $(Z_o)^2$, $Z_s$ will be very small. In fact, $Z_s$ will approach 0 ohms, or a short circuit. It will also be seen that a small $Z_r$ in comparison to $(Z_o)^2$ will yield a $Z_s$ that tends to approach infinity, or an open circuit. It is these two principles of a quarter wavelength transmission line that are utilized in the non-contacting electrical coupler of the present invention.

Figure 1:
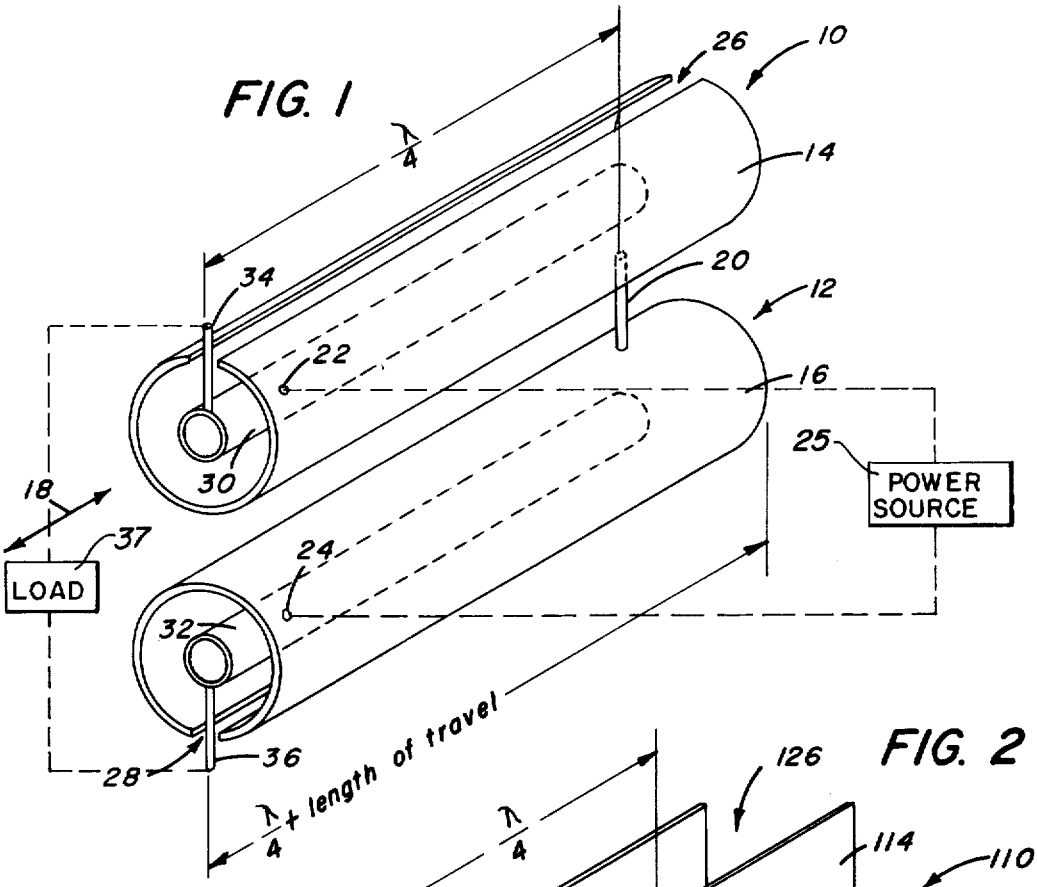
FIG. 1 illustrates a first embodiment of the non-contacting coupler of the present invention.

Referring now to FIG. 1, two modified coaxial transmission lines 10 and 12 are illustrated which comprise the non-contacting electrical coupler of the present invention. The transmission lines 10 and 12 comprise and first generally tubular conductor members 14 and 16, respectively, arranged in substantially parallel relationship to each other and to the direction of motion of the movable device, generally indicated by arrow 18. Each of the tubular conductors, 14 and 16, have a length substantially equal to $\lambda/4$, where $\lambda$ is the mean operating wavelength of the devices, plus the distance of travel to be accomodated by the coupler. The two first conductor members 14 and 16 are electrically connected together, or shorted, by a shorting member 20 located a distance substantially equal to $\lambda/4$ from a first end of the first conductor members. Each of the first conductor members 14 and 16 is provided with first terminal means 22 and 24, respectively, located at or near the first end thereof for electrically connecting each of the first conductor members to opposite sides of one of the electrical devices, for example, a stationary high frequency power source 25. The first conductor members are provided with slots or openings, 26 and 28, respectively through the walls thereof which extend axially along the length thereof. A pair of movable inner second conductor members 30 and 32 are disposed substantially coaxially, one within each of the first conductor members 14 and 16. Each of the second inner conductor members has a cross section similar to that of the first, outer conductor members and has a length substantially equal to $\lambda/4$. Each of the second conductor members 30 and 32 is provided with second terminal means 34 and 36 at one end thereof, electrically connecting each of the second conductor members to opposite sides of the second high frequency device, for example, the linearly movable load 37. The second terminal means are arranged to extend through the slots 26 and 28, respectively, in the first conductor members 14 and 16.

In a preferred embodiment of the present invention the inner second conductor members 30 and 32 are supported axially movable relationship in the first conductors in radially spaced, insulating relationship therewith by the terminal members 34 and 36 which extend through slots 26 and 28 to the linearly movable high frequency load. The load is structurally supported in an insulated manner by any common mechanical arrangement. Thus, in operation, as the linearly movable load is moved in a direction parallel to arrow 18, the inner conductor members 30 and 32, being physically as well as electrically connected to the load via terminals 34 and 36, will be moved axially within the first conductor members 14 and 16. If any additional support members are necessary for the second conductor members within the first conductor members, they are formed of a low-loss insulator to prevent any electrical contact between the inner conductor members and the outer conductor members.

As described above, the first terminal members 22 and 24 connecting the outer conductor members to the power supply, and the second terminal members 34 and 36 connecting the inner second conductor members to the load, are disposed at the same end of the coupler. Thus, when terminals 22 and 34 are closest to each other, at one limit of the axial travel, a virtual short circuit appears between them. The same is true for terminals 24 and 36. Thus, the load connected to terminals 34 and 36 will appear as if it were connected to terminals 22 and 24. A parasitic transmission line of the parallel conductor type is formed between the first conductor members 14 and 16. The shorting stub 20, located a distance substantially equal to $\lambda/4$ from the terminals 22 and 24 makes the parallel line affect negligible in comparison to the lead impedance. As the second conductor members 30 and 32 move within the first conductor members 14 and 16, the virtual shorts from terminal 34 to the first conductor 14, and from terminal 36 to conductor 16, move with respect to terminals 22 and 24. This results in impedance transformation due to the characteristics of the parasitic transmission line. Accordingly, the amount of axial movement of the coupling depends, to a certain extent, upon the degree of impedance transformation that can be tolerated. Step up transformation of load impedance prior to connection to the coupling device and/or lowering operating frequency will reduce the affect of the parasitic line. Lower operating frequencies will give a more constant transformation per unit distance than higher frequencies. Moving the terminals 22 and 24 some distance from the first end of the first conductors 14 and 16 wil tend to maximize the total travel distance available.

A specific example of the coupler illustrated in FIG. 1 was constructed from copper tubing wherein the first conductor members 14 and 16 had an I. D. of 1.62 inches and a length of 34 inches. The slots 26 and 28 through the walls thereof were 0.28 inches wide. The second, inner conductor members 30 and 32 were formed of copper tubing having an O. D. of 0.50 inches and a length of 26 inches. The operating frequency was 101 MHZ. The coupler had a usable axial travel of 9 inches. A transfer efficiency of better than 97% was achieved for a resistive load range of 100 ohms to 450 ohms. With the terminals 22 and 24 located 3 inches from the first end of the first conductor members 14 and 16, the transformation ratio varied from 0.98:1 to 1.3:1 for a 53 ohm load, and from 0.99:1 to 1.23:1 for a 328 ohm load. This non-contacting electrical coupler was utilized to connect a reciprocating dielectric sealing head to a stationary power source. The sealing head was arranged to move linearly with a moving web while the sealing jaws were clamped to the web. After the sealing cycle was completed, the jaws separated, releasing the sealed web, and returned linearly to the start position to again clamp the web to start the next sealing cycle. The present non-contacting coupler device operated satisfactorily and reduced the maintenance necessary on the previous flexible transmission line utilized in that construction. Although the present coupler is intended primarily to permit linear movement of the conductor members, a certain degree of radial movement is also permitted. Thus, the radial spacing of the second conductor members 30 and 32 within the first conductor members 14 and 16 permits a certain, limited amount of radial movement of the second conductor members therein, permitting the sealing jaws to open and close on the web. This results from the fact that it is not absolutely necessary that the second conductor members travel on the axial centerline of the first conductor members; in other words, the conductor members need not be truly coaxial. This is shown by the above equation in that, as long as the second conductor members have a length substantially equal to $\lambda/4$, the impedance $Z_o$ of the line has a negligible effect when the load impedance $Z_r$ is large.

Figure 2:
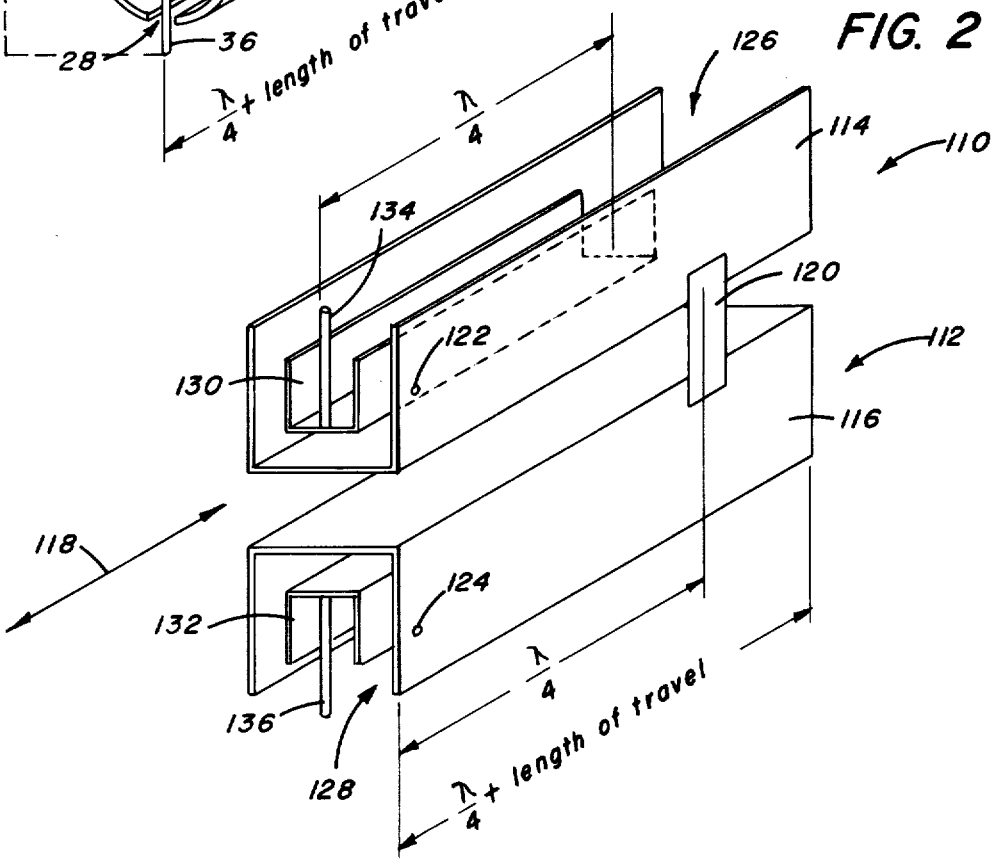
FIG. 2 shows a second embodiment of the non-contacting electrical coupler of the present invention.

Thus, the non-contacting coupler conductor members may have a configuration other than that of a cylindrical tube, such as that illustrated in a second embodiment in FIG. 2. In this embodiment, similar elements to those described with respect of FIG. 1 are provided with the same reference numerals with the prefix "1. " In this embodiment the first conductor members 114 and 116 of the coupling element are constructed of $\frac{1}{8}$ thick aluminum channel members which have inside dimensions of 1.5 inches $\times$ 1.5 inches and a length of 35 inches. The second, inner conductor members 130 and 132 are formed of aluminum channel members having a thickness of 1/16 inch, with inner dimensions of 0.5 inch × 0.5 inch and a length of 27 inches. With this coupler a transfer efficiency of better than 94% was achieved for resistive loads in the range of 100 ohms to 450 ohms. It will be seen that the use of the channel members reduces the alignment problems between the first conductor members and the second conductor members over those in the first embodiment. Moreover, the "radial" movement permitted with this embodiment is significantly increased over that of the embodiment of FIG. 1 since there is no "top" to the first conductor members which would prevent or limit the "radial" movement of the second conductor members therein.

It has been found that the dimensional tolerances of the non-contacting coupler of the present invention are not very stringent. The spacing between the first and second conductor members must only be such that arcing is prevented therebetween, and the distance between the first and second conductor members can be as great as 2 inches before the transmission effect is lost. As previously noted, the slots in the first conductor members may be positioned about the circumference thereof other than that shown, and need not run the entire length of the outer conductor members. The only limitation with respect to the circumferential placement of the axial slots is that they not be located so closely together that an appreciable transmission line effect occurs between the two second conductor members.

The non-contacting electrical coupler of the present invention has been utilized to transmit 5 kw of power and can be utilized to transmit up 100 kw of power at the frequencies noted above. A practical upper limit of frequency is approximately 1,000 MHZ. The lower operating frequency limit is determined by the space available. The amount of linear movement possible, compared to the ¼ wavelength distance, will be determined by the consistency of load impedance required. In the case where the operating frequency is high and the linear movement is equal to several quarter wavelength distances, it would be possible to locate the connector 20 from the first end a distance equal to odd multiples of the ¼ wavelength distance. Such an application would, without further modification, provide pulsating energy transfer to the load with a wide range of impedance excursion. The amount of such impedance excursions that can be tolerated would determine the practicality of such a device.

Figure 3:
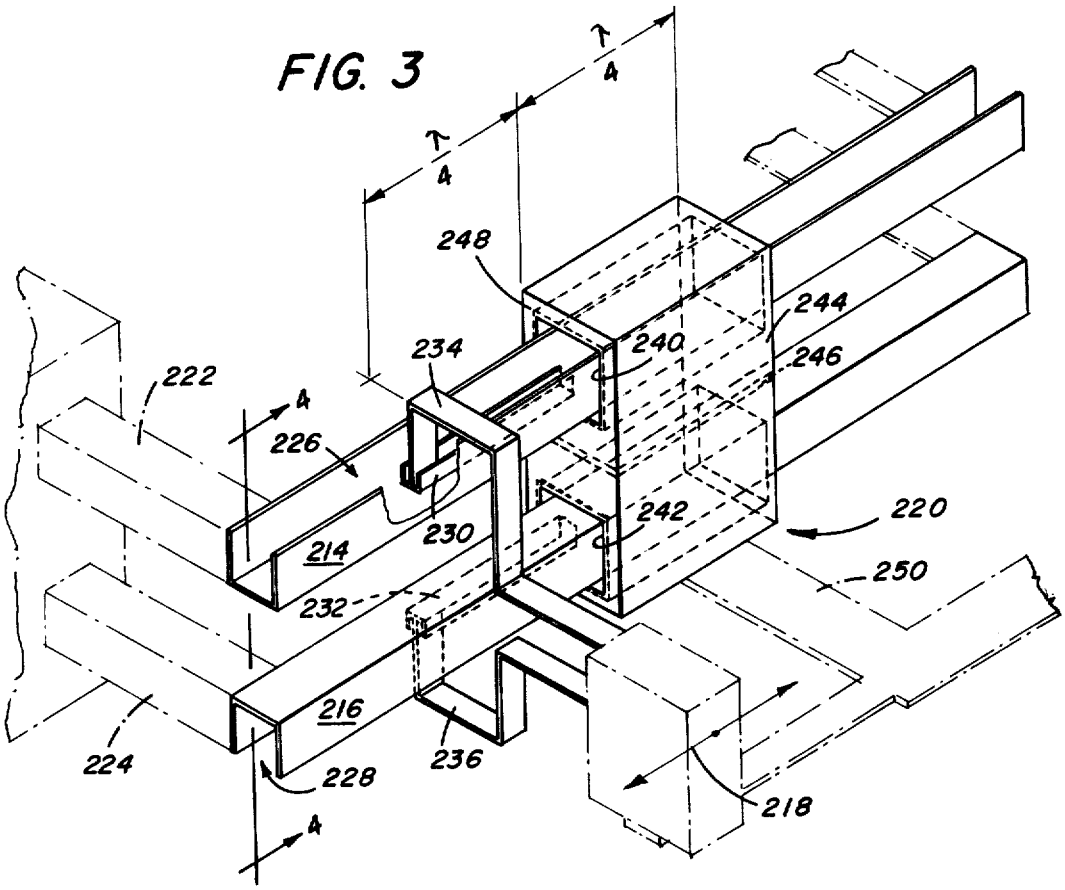
FIG. 3 shows a third embodiment of the non-contacting electrical coupler of the present invention.
Figure 4:
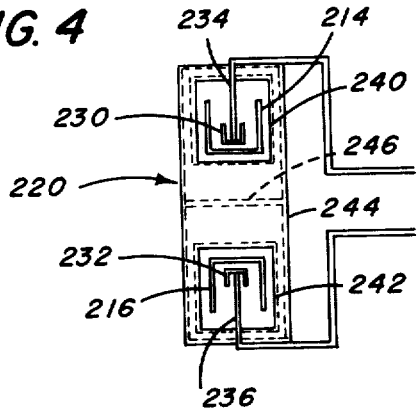
FIG. 4 shows a view taken along line 4—4 of FIG. 3.

Another embodiment is illustrated in FIGS. 3 and 4 which permits the operation of the coupling device of the present invention over extended lengths of travel while minimizing, if not eliminating, the impedance excursions noted above for travel over distances greater than ¼ wavelength. In this illustration similar elements to those illustrated in FIG. 1 are given the same reference numerals with the prefix "2." This embodiment permits substantially greater axial travel than that of the devices illustrated in FIGS. 1 and 2. This is accomplished by substituting a moving connector element 220 in place of the stationary shorting element 20 or 120 of the other embodiments. The element 220 is arranged to be supported by and moved with the moving load so that the connection between the stationary first conductor members 214 and 216 always appears to be spaced from the terminal connections 234 and 236 to the moving second conductor members 230 and 232 a distance substantially equal to a quarter wavelength.

The moving connector element 220 comprises a pair of tubular elements 240 and 242 which have cross sections similar to and surround the first and second conductor members 214 and 216. The tubular elements 240 and 242 are disposed in spaced relationship about the first conductor members and are arranged for movement therealong. A compound tubular member 244 is disposed in spaced relationship about the tubular members 240 and 242 and includes a center wall portion 246 that extends between the adjacent tubular members. A first end of the moving connector element 220 is formed of an electrically conducting end plate 248 that joins the ends of tubular members 240 and 242 with the end of the compound tubular member 244. The opposite end of the moving connector element 220 is provided with a non-electrically connecting wall member that supports the respective ends of tubular members 240 and 242 and that end of the compound tubular member. The moving connector element 220 is supported from the moving load device by an insulated support 250 so that the moving connector element is movable in spaced relation along the first conductor members 214 and 216 along with the moving second conductor members 230 and 232. The moving connector element 220 has a length substantially equal to ¼ wavelength, the end thereof with the conducting end plate 248 being the closest to the second terminal means 234 and 236, connecting the second conductor members to the moving load, and being spaced therefrom by a distance substantially equal to ¼ wavelength.

This results in a negligible loading from the parasitic line no matter where the load is located relative to the terminal members. It has been found that the parasitic transmission line between the input terminal means and the load terminal means will have the same effect on load voltage and feed point input impedance as any normal transmission line of similar construction. The parasitic line is thus arranged to have an impedance equivalent to that appearing at the load terminal means. This permits the greatest amount of load travel with minimal variation of feed point input impedance and load voltage. The moving connector element 220 functions substantially like the coupler described in the first two embodiments. Thus, an unterminated quarter, wavelength transmission line is formed by the tubular elements 240 and 242 and the stationary first conductor members 214 and 216. This results in a virtual connection, on the feed side of the moving connector element 220, between the tubular elements and the associated first conductor members 214 or 216.

The end plate 248 has two functions. It connects the upper and lower rectangular tubular elements 240 and 242 and it creates a short circuit between the compound tubular member 244 and the tubular elements. Thus, the first conductor members 214 and 216 are shorted together. Also, the first tubular element 240 and the related portion of the compound tubular member 214 form a quarter wavelength transmission line which is terminated in a short circuit. This short is reflected to the other end of the line as an open circuit. This assures open terminations for the transmission lines formed by the inner tubular members and the stationary first conductor members. Thus, the compound tubular member serves as a shield for stray transmission effects. It will thus be seen that this embodiment extends the amount of linear movement possible with the coupler of the present invention.

While the embodiments described hereinabove have generally illustrated coupler elements wherein the first, outer conductor members are stationary with the second, inner conductor members moving relative thereto, it will be appreciated that the inner conductor members may be held stationary with the outer conductor members moving. Moreover, it is possible that both the inner and outer conductor members more relative to some fixed point and with respect to each other. Further, the connection of the first conductor members to the power source and the second conductor members to the load can be reversed so that the first conductor members are connected to the load without departing from the present invention. Still further, the movable load may be connected via the coupling element of the present invention to a second, stationary load, which in turn is connected to a stationary power source.

It will be understood that the first, outer conductors are preferably provided with insulating supports, of a type known in the art, to physically support them in operation. Also, it will be apparent to those skilled in the art that a balun feed connection to the first, outer conductors will provide the most satisfactory operation of the present coupler. Any type balun connection may be used.

The present invention thus provides a relatively simple, non-contacting electrical coupler which permits linear motion between a high frequency power source and a high frequency load without requiring flexible cables or other elements requiring extensive maintenance.

The invention has been described in detail with particular reference to preferred embodiments thereof, but it will be understood that variations and modifications can be effected within the spirit and scope of the invention.

I claim:

1. An electric coupler for connecting a first high frequency device to a second high frequency device, said coupler arranged to permit relative linear movement between said first and second devices, said devices having a mean electrical energy operating wavelength of λ, said coupler comprising a first pair of parallel conductor members each having generally tubular walls, each of said first conductor members having an axially extending opening through the wall thereof, first terminal means at corresponding first ends of said first pair of conductor members electrically connecting them across said first device, means for electrically coupling the first pair of conductor members together at a distance from said first end substantially equal to an odd multiple of λ/4, a second pair of conductor members disposed one within each of said first conductor members, said second conductor members being insulated from the walls of said first conductor members, said second conductor members being movable axially within and relative to said first conductor members and having a length substantially equal to λ/4, and second terminal means for electrically connecting said second pair of conductor members across said second device, said second terminal means being connected to said second conductor members at corresponding first ends thereof relatively adjacent said first ends of said first pair of conductor members, said second terminal means extending through said axially extending openings through the walls of said first conductor members.

2. The invention according to claim 1 wherein said first conductor members are disposed parallel to the direction of said relative motion.

3. The invention according to claim 1 wherein said second terminal means support said second conductor members coaxially within said first conductor members.

4. The invention according to claim 1 wherein said second conductor members are spaced from the inner surface of said first conductor members.

5. The invention according to claim 1 wherein said first conductor members have a length substantially equal to λ/4 plus the distance of motion of the second conductor members.

6. The invention according to claim 1 wherein said second conductor members reciprocate linearly in conjunction with a reciprocating load.

7. The invention according to claim 6 wherein said second conductor members are also movable radially within said first conductor members.

8. The invention according to claim 1 wherein said first tubular conductor members have a generally circular cross section.

9. The invention according to claim 1 wherein said first tubular conductor members have a generally square cross section.

10. An electric coupler for connecting a first high frequency device to a second high frequency device, said coupler arranged to permit relative linear movement between said first and second devices, said devices having a mean electrical energy operating wavelength of λ, said coupler comprising a first pair of parallel conductor members each having generally tubular walls, each of said first conductor members having an axially extending opening through the wall thereof, first terminal means at corresponding first ends of said first pair of conductor members electrically connecting them across said first device, means for electrically coupling the first pair of conductor members together, a second pair of conductor members disposed one within each of said first conductor members, said second conductor means being insulated from the walls of said first conductor members, said second conductor members being moveable axially within the relative to said first conductor members and having a length substantially equal to λ/4, and second terminal means for electrically connecting said second pair of conductor members across said second device, said second terminal means being connected to said second conductor members at corresponding first ends thereof relatively adjacent said first ends of said first pair of conductor members, said second terminal means extending through said axially extending openings through the walls of said first conductor members, said means for electrically coupling said first conductor members together comprising first and second generally tubular members disposed in spaced relationship one about each of said first conductor members and a compound tubular member enclosing said first and second tubular members, said compound tubular member having a common wall member between said first and second tubular members, and an electrically conducting end wall member connecting said first, second, and compound tubular members together, said end wall member supporting said first and second tubular members in spaced relation within said compound tubular member, said first, second, and compound tubular members all having a length substantially equal to λ/4 and arranged for relative axial movement along said first conductor members, said end wall member being located at the end of said first, second, and compound tubular members closest to said second conductor members and being spaced from the second terminal means by a distance substantially equal to λ/4, and non-conducting means supporting said coupling means to move with said second device.

* * * * *